US009541271B2

(12) United States Patent
Lu

(10) Patent No.: US 9,541,271 B2
(45) Date of Patent: Jan. 10, 2017

(54) BULB HEAD STRUCTURE AND LED BULB COMPRISING THE SAME

(71) Applicant: KUNSHAN NANO NEW MATERIAL TECHNOLOGY CO.,LTD., Jiangsu (CN)

(72) Inventor: Hung-Tu Lu, Taipei (TW)

(73) Assignee: KUNSHAN NANO NEW MATERIAL TECHNOLOGY CO., LTD, Jiangsu (CN)

( * ) Notice: Subject to any disclaimer, the term of this patent is extended or adjusted under 35 U.S.C. 154(b) by 100 days.

(21) Appl. No.: 14/590,494

(22) Filed: Jan. 6, 2015

(65) Prior Publication Data

US 2016/0131310 A1 May 12, 2016

(30) Foreign Application Priority Data

Nov. 10, 2014 (TW) ..... 103219899 U

(51) Int. Cl.
*F21V 23/06* (2006.01)
*F21Y 101/00* (2016.01)
*F21V 19/00* (2006.01)

(52) U.S. Cl.
CPC ..... *F21V 23/06* (2013.01); *F21K 9/232* (2016.08); *F21K 9/238* (2016.08); *F21V 19/0055* (2013.01); *F21Y 2101/00* (2013.01)

(58) Field of Classification Search
CPC ..... F21K 9/13; F21K 9/135; F21K 9/1355; F21K 9/1375; F21V 17/164; F21V 19/004; F21V 19/0055; F21V 23/002;F21V 23/004; F21V 23/006; F21V 23/06; F21V 29/004; F21V 29/506; F21V 29/70; F21V 29/83; F21V 3/02; F21Y 2101/02; F21Y 2103/003; F21Y 2103/10; H01L 33/507
See application file for complete search history.

(56) References Cited

U.S. PATENT DOCUMENTS 8,803,412 B2 * 8/2014 Sanders ..... H05B 33/0803 313/485
2010/0277067 A1 * 11/2010 Maxik ..... F21V 3/00 315/32

(Continued)

*Primary Examiner* — Hargobind S Sawhney
(74) *Attorney, Agent, or Firm* — Muncy, Geissler, Olds & Lowe, P.C.

(57) ABSTRACT

A bulb head structure and an LED bulb comprising the same are provided. The bulb head structure includes a hollow-shaped member which is a hollow cup-shaped structure, and an outer surface of an end is disposed with a lampholder connecting part, an inner insulating member, a substrate, two flexible electrode members which are respectively disposed at side edge and one end of the substrate, and a conduction member. The inner insulating member and the substrate are disposed in the hollow-shaped member, the inner insulating member is adjacent to one end of the hollow-shaped member, and the substrate and the conduction member are respectively disposed at two sides of the inner insulating member. Wherein, one flexible electrode member contacts with the hollow-shaped member and the other flexible electrode member contacts with the conduction member to enable the substrate electrically connecting to the hollow-shaped member and the conduction member respectively.

13 Claims, 7 Drawing Sheets

(56) References Cited

U.S. PATENT DOCUMENTS

| | | | | |
|---|---|---|---|---|
| 2011/0001417 | A1* | 1/2011 | Stekelenburg | F21K 9/135 313/46 |
| 2012/0120661 | A1* | 5/2012 | Uemoto | F21K 9/1375 362/249.03 |
| 2013/0286645 | A1* | 10/2013 | Bukkems | F21K 9/135 362/227 |
| 2014/0078753 | A1* | 3/2014 | Araki | F21K 9/1355 362/373 |
| 2015/0070908 | A1* | 3/2015 | Yang | F21K 9/1355 362/362 |
| 2015/0103535 | A1* | 4/2015 | Hu | F21V 31/00 362/363 |
| 2016/0131355 | A1* | 5/2016 | Grajcar | F21K 9/1355 362/234 |

* cited by examiner

BULB HEAD STRUCTURE AND LED BULB COMPRISING THE SAME

CROSS-REFERENCE TO RELATED APPLICATION

This application claims priority from Taiwan Patent Application No. 103219899, filed on Nov. 10, 2014, in the Taiwan Intellectual Property Office, the content of which are hereby incorporated by reference in their entirety for all purposes.

BACKGROUND OF THE INVENTION

1. Field of the Invention

This application relates to a bulb head structure, and more particularly, to a bulb head structure and an LED bulb comprising the same which are applied to the LED bulb.

2. Description of the Related Art

Light emitting diode (LED) enables to transform electrical energy into light energy effectively with a longer service life and lower power consumption, and as a result, it is gradually applied and commonly used in the regular illumination apparatus.

Regarding the conventional application to the LED illumination apparatus, such as bulb, the means of power connection is to connect the power substrate with the bulb's electrode contact to transmit the electric power, and the electric cable is mostly used to connect the power substrate with the bulb's electrode. In the process, however, the electric cable may usually need to be bent owing to the diversity of different working stations, and thus, the electric conductivity thereof may be lowered as the electric cable breaks.

Additionally, in the assembling process of the product, the electric cable has to be fixed on the power substrate and the bulb's electrode contact by soldering so as to accomplish the capability of electrical conductivity adequately, and because the electric cable per se is soft, the cables may need to be managed manually. As a result, the aforementioned situations may result in lower productive efficiency such that the manufacturing process of the product may be unfavorable to automated production.

As described above, inventor of the present invention has been mulling the technical problems over and then designs a bulb head structure and an LED bulb comprising the same which aim at improving the current technique so as to promote the industrial applicability.

SUMMARY OF THE INVENTION

In view of the preceding technical problems, the purpose of the present invention is to provide a bulb head structure and an LED bulb comprising the same to resolve the problems of complicated assembling procedure of the exiting LED bulb and is unfavorable to automated production.

According to one purpose of the present invention, a bulb head structure is provided, which may include a hollow-shaped member, an inner insulating member, a substrate, a first flexible electrode member, a second flexible electrode member and a conduction member. The hollow-shaped member may be made of a conductive material, and an outer surface of an end of the hollow-shaped member may have a lampholder connecting part; the inner insulating member may be disposed in the hollow-shaped member and adjacent to the end of the hollow-shaped member; the substrate may be disposed in the in insulating member; the first flexible electrode member may be disposed on a surface of the substrate and adjacent to a side wall of the substrate, and the first flexible electrode member may be in contact with the hollow-shaped member to establish an electrical connection between the hollow-shaped member and the substrate; the second flexible electrode member may be disposed on the surface of the substrate near an end of the substrate and adjacent to the inner insulating member; and the conduction member may be disposed in the inner insulating member, and the second flexible electrode member may be in contact with an end of the conduction member to establish an electrical connection between the conduction member and the substrate.

Preferably, the inner insulating member may be disposed with a substrate-receiving part, and one end of the substrate may be disposed with the second flexible electrode member which may be inserted in the substrate-receiving part.

Preferably, the substrate-receiving part may be arranged as two grooves which may be opposite to each other, and a distance between bottoms of the two grooves may be equal to or slightly smaller than a width of the end of the substrate disposed with the second flexible electrode member.

Preferably, the inner insulating member may have a conduction member receiving part which may be disposed at another end of the inner insulating, another end of the inner insulating member is opposite to the substrate-receiving part, and the conduction member may be inserted or attached to the conduction member receiving part.

Preferably, the first flexible electrode member may have a first contact part that can be elastically deformed subject to applied force, and the first contact part may extend through the side wall of the substrate to contact the hollow-shaped member, a distance between the first non-elastically-deformed contact part and the side wall of the substrate may be larger than a distance between the side wall of the substrate and an inner wall surface of the hollow-shaped member.

Preferably, the second flexible electrode member may have a second contact part that can be elastically deformed subject to applied force, and the second contact part may extend through the end of the substrate to contact the conduction member, a distance between the non-elastically-deformed second contact part and the end of the substrate may be larger than a distance between the end of the substrate and the end of the conduction member.

Preferably, an outer insulating member may be further comprised, which may be adjacent to another end of the hollow-shaped member and may partially cover an outer surface of the hollow-shaped member, and the outer insulating member and the inner insulating member may be disposed on the hollow-shaped member through wrapping by injection manufacturing process.

According to another purpose of the present invention, an LED bulb is provided, which may include a hollow-shaped member, an inner insulating member a substrate, a conduction member and a cover member. The hollow-shaped member which may be a hollow cup-shaped structure made of conductive material, and an outer surface of an end of the hollow-shaped member may have a lampholder connecting part; the inner insulating member may be disposed in the hollow-shaped member and adjacent to the end of the hollow-shaped member; the substrate may be disposed in the inner insulating member and may include a first flexible electrode member and a second flexible electrode member, the first flexible electrode member and the second flexible electrode member may be disposed on a surface of the substrate, wherein the first electrode flexible may be adjacent to a side wall of the substrate to substantially contact with the hollow-shaped member so as to establish an electrical connection between the hollow-shaped member and the substrate, and the second flexible electrode member may be disposed at an end of the substrate adjacent to the inner insulating member; the conduction member may be disposed in the inner insulating member, and the second flexible electrode member may substantially contact with an end of the conduction member so as to establish an electrical connection between the conduction member and the substrate; the cover member may be disposed at another end of the hollow-shaped member, and the cover member may be disposed with an LED module. The LED module may be disposed on a surface of the cover member opposing to the substrate, and the LED module may be electrically connected to the substrate.

Preferably, the inner insulating member may be disposed with a substrate-receiving part, and one end of the substrate disposed with the second flexible electrode member may be inserted in the substrate-receiving part.

Preferably, the substrate-receiving part may be arranged as two grooves which may be opposite to each other, and a distance between bottoms of the two grooves may be equal to or slightly smaller than a width of the end of the substrate disposed with the second flexible electrode member.

Preferably, the inner insulating member may have a conduction member receiving part disposed at an end of the inner insulating member. The end of the inner insulating member may be opposite to the substrate-receiving part, and the conduction member may be inserted or attached to the conduction member receiving part.

Preferably, the first flexible member may have a first contact part that can be elastically deformed subject to applied force, and the first contact part may extend through the side wall of the substrate to contact the hollow-shaped member. A distance between the non-elastically-deformed first contact part and the side wall of the substrate may be larger than a distance between the side wall of the substrate and the inner wall surface of the hollow-shaped member.

Preferably, the second flexible electrode member may have a second contact part that can be elastically deformed subject to applied force, and the second contact part may extend through the end of the substrate to contact the conduction member. A distance between the non-elastically-deformed second contact part and the end of the substrate may be larger than a distance between the end of the substrate and o the end of the conduction member.

Preferably, an outer insulating member may be further comprised, which may be adjacent to another end of the hollow-shaped member and may partially cover an outer surface of the hollow-shaped member, and the outer and the inner insulating members may be disposed on the hollow-shaped member through wrapping by injection manufacturing process.

Preferably, the LED module may be disposed with a connecting unit on the surface of the cover member which may face the substrate, another end of the substrate opposing to the end of the substrate having the second flexible electrode member may be disposed with a conductive part, and the conductive part may be inserted in the connecting unit.

According to the preceding descriptions, a bulb head structure and an LED bulb comprising the same in accordance with the present invention may have one or more advantages as follows.

(1) A bulb head structure and an LED bulb comprising the same in accordance with the present invention utilize the arrangement of a first flexible electrode member and a second flexible electrode member to replace the conventional current-conduction way using electric cables. By means of present invention, the automatical surface mounting technology (SMT) may be applied to a substrate to promote the production efficiency and yield rate.

(2) A bulb head structure and an LEI) bulb comprising the same in accordance with the present invention are configured to directly insert a substrate, a conduction member and a cover member in the corresponding assembly position by means of deposition of a first flexible electrode member and a second flexible electrode member, the production efficiency is thereby increased and automated production is easily to be applied as well.

DETAILED DESCRIPTION OF THE PREFERRED EMBODIMENTS

Figure 1:
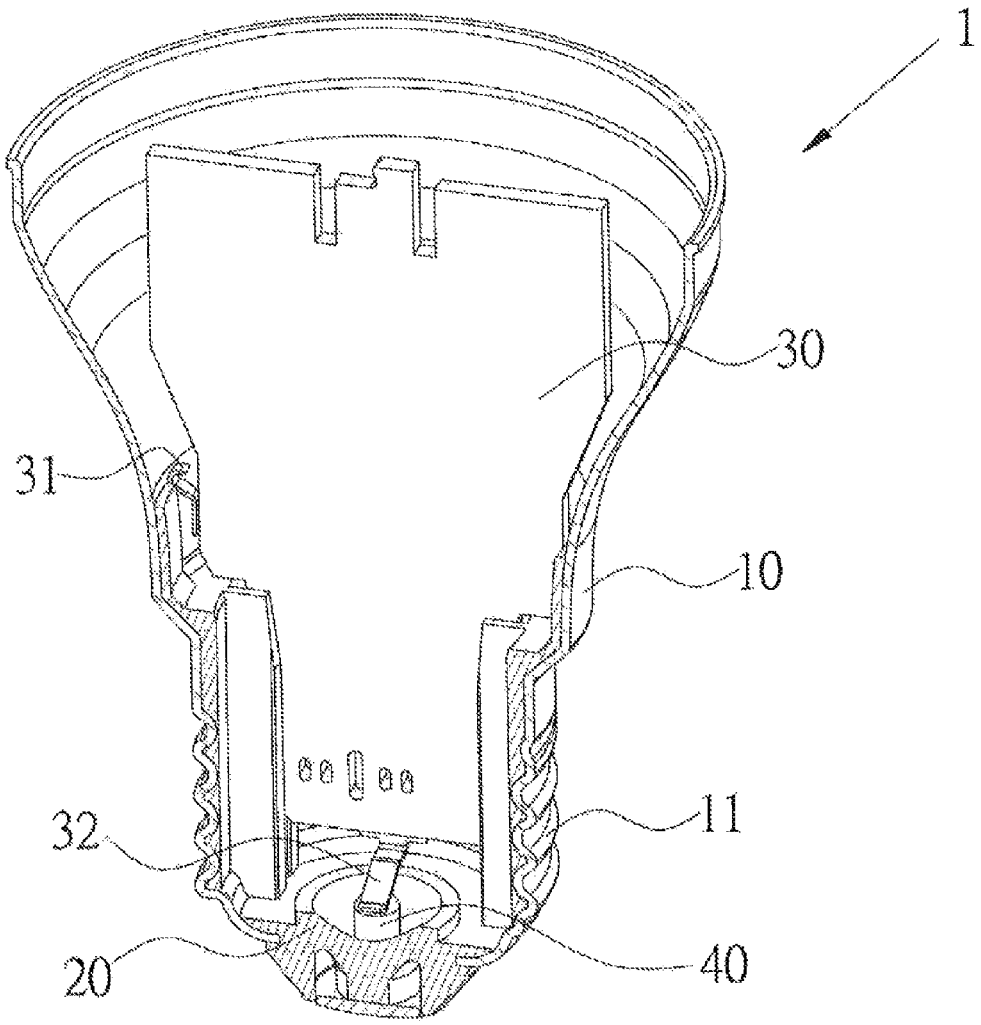
FIG. 1 is a cross-sectional diagram for showing a bulb head structure in accordance with the present invention.

Hereinafter, embodiments of the present invention will be described in detail with reference to the accompanying drawings so that those skilled in the art to which the present invention pertains can realize the present invention. As those skilled in the art would realize, the described embodiments may be modified in various different ways, all without departing from the spirit or scope of the present invention.

The drawings and description are to be regarded as illustrative in nature and not restrictive. Similar reference numerals designate similar elements throughout the specification.

Please refer to FIG. 1 to FIG. 4 together which are a cross-sectional diagram for showing a bulb head structure, a schematic diagram of a first flexible electrode member of a bulb head structure contacting with a hollow-shaped member, a schematic diagram of a second flexible electrode member of a bulb head structure contacting with a conduction member and a schematic diagram of a substrate of a bulb head structure being disposed in an inner insulating member in accordance with the present invention, respectively. The primary purpose of the present invention aims at improving the current LED bulb structure which is configured to connect the substrate used to control power source with electrode (contacts for supplying power) by wiring such that when product of LED bulb is being assembled, the operation of automated production can therefore be fully accomplished.

As shown in FIG. 1, a bulb head structure 1 of the present invention includes a hollow-shaped member 10, an inner insulating member 20, a substrate 30, a first flexible electrode member 31, a second flexible electrode member 32 and a conduction member 40. The hollow-shaped member 10 is a hollow cup-shaped structure made of conductive materials such as aluminum or alloy thereof through spinning manufacturing process, and an outer surface of one end of the hollow-shaped member 10 has a lampholder connecting part 11 which is used to fix or connect to a lampholder so as to obtain electric power. Preferably, the lampholder connecting part 11 may be the connectors with conventional bulb head specification such as E12, E14 and E27 and so on. The inner insulating member 20 may be made of non-conductive materials such as plastic, and is disposed in inner of one end of the hollow-shaped member 10, and the shape is mainly formed corresponding to the inner of the end of the hollow-shaped member 10. The first flexible electrode member 31 and the second flexible electrode member 32 are disposed on the substrate 30, and the substrate 30 is disposed in inner of the hollow-shaped member 10 adjacent to one end of the inner insulating member 20, and the shape of the substrate 30 is formed as an elongated-shaped structure to mainly correspond to the inner of the hollow-shaped member 10. The conduction member 40 is the so-called bulb-eye which is made of conductive material, and is disposed at another end of the inner insulating member 20.

The first flexible electrode member 31 and the second flexible electrode member 32 are flexible members having a certain elastic restoring force, and may be made of conductive materials such as stainless steel, carbon steel and manganese steel and so on. The first flexible electrode member 31 is disposed on the surface of the substrate 30 and adjacent to a side wall of the substrate 30, and the first flexible electrode member 31 may lean against the inner wall surface of the hollow-shaped member 10 so as to substantially contact with the hollow-shaped member 10 (shown in FIG. 2). And the hollow-shaped member 10 and the substrate 30 may thus be electrically connected via the first flexible electrode member 31. The second flexible electrode member 32 is disposed on the surface of the substrate 30 and at one end of the substrate 30, and is adjacent to the inner insulating member 20. The second flexible electrode member 32 may lean against one end of the conduction member 40 so as to substantially contact with the conduction member 40 (shown in FIG. 3). And the conduction member 40 and the substrate 40 may thus be electrically connected via the second flexible electrode member 32. The first flexible electrode member 31 and the second flexible electrode member 32 may be directly disposed on the substrate 30 in the process of SMT. That is, when performing the follow-up assembling operation, it is unnecessary to solder the first flexible electrode member 31 and the second flexible electrode member 32.

Figure 2:
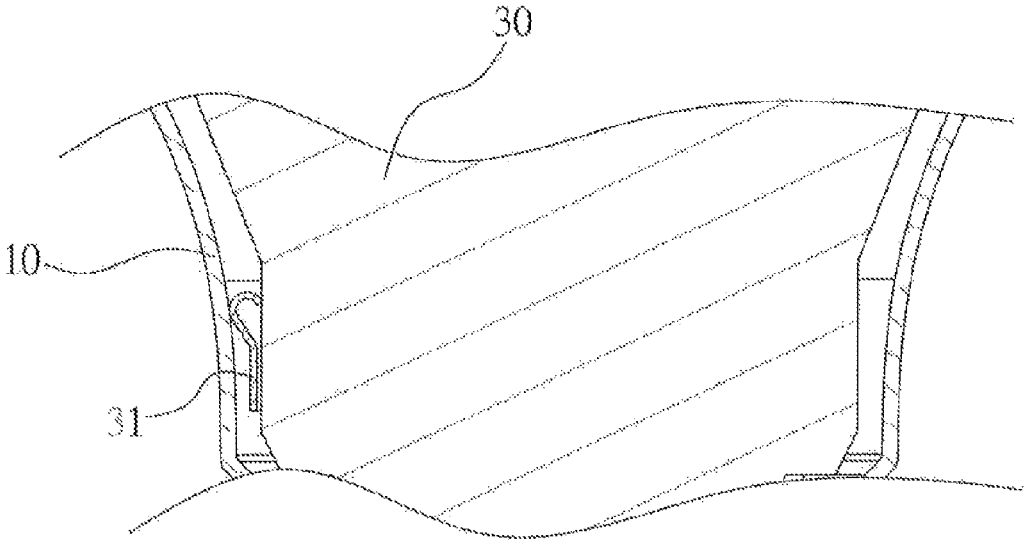
FIG. 2 is a schematic diagram of a first flexible electrode member of a bulb head structure in accordance with the present invention contacting with a hollow-shaped member.

Furthermore, as shown in FIG. 2, the first flexible electrode member 31 has a first contact part 311 that can be elastically deformed subject to applied force. The first contact part 311 extends through the side wall of the substrate 30 to outside the substrate 30, and while not deformed, a distance between the first contact part 311 and the side wall of the substrate 30 may be larger than a distance between the side wall of the substrate 30 and the inner wall surface of the hollow-shaped member 10. Hence, when the substrate 30 is disposed inside the hollow-shaped member 10, the first flexible electrode member 31 may become stable and continuously lean against the inner wall surface of the hollow-shaped member 10 through elastic restoring force, such that the first flexible electrode member 31 may produce better conductivity as it contacts the inner wall surface of the hollow-shaped member 10 perfectly.

Figure 3:
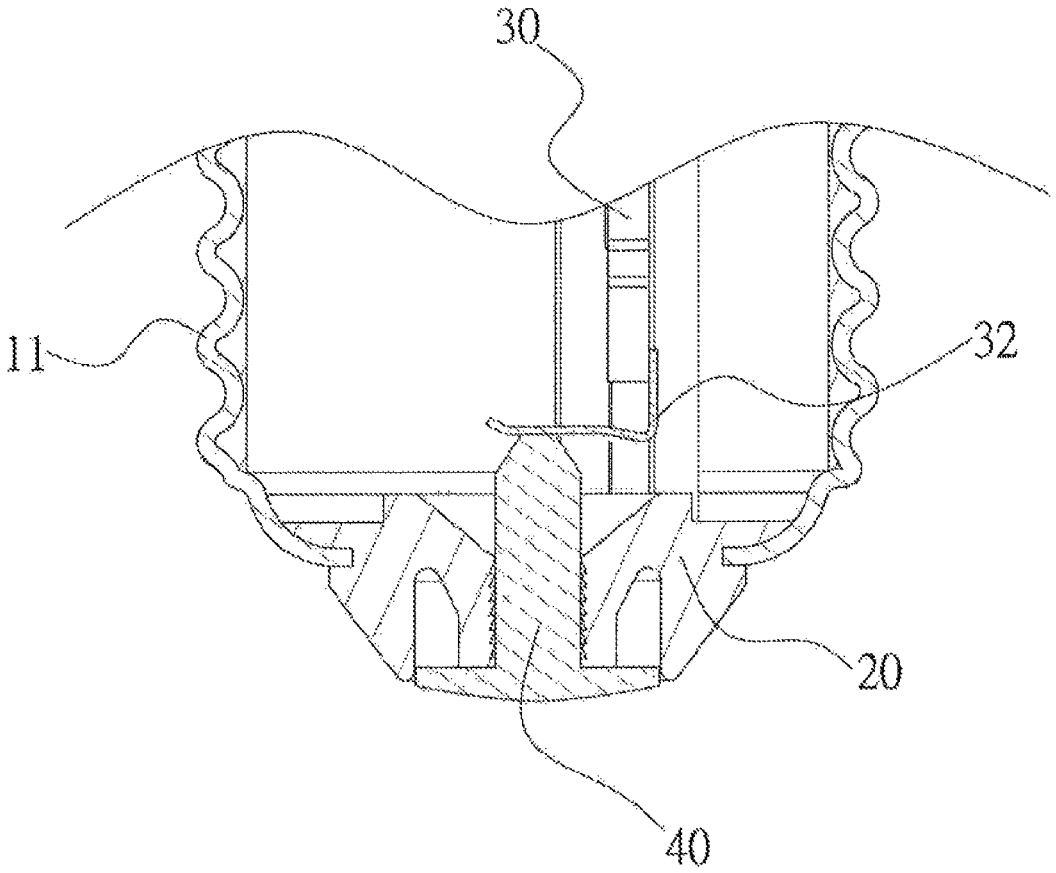
FIG. 3 is a schematic diagram of a second flexible electrode member of a bulb head structure in accordance with the present invention contacting with a conduction member.

As shown in FIG. 3, similarly, the second flexible electrode member 32 has a second contact part 321 that can be elastically deformed subject to applied force. The second contact part 321 extends through the end (adjacent to one end of inner the insulating member 20) of the substrate 30 to outside the substrate 30, and a distance between the non-elastically-deformed second contact part 321 and the end of the substrate may be larger than a distance between the end of the substrate 30 and the end of the hollow-shaped member 40. Hence, when the substrate 30 is disposed inside the hollow-shaped member 10 and the conduction member 40 is disposed in the inner insulating member 20, the second flexible electrode member 32 may become stable and continuously lean against the end of the conduction member 40 through elastic restoring force, such that the second flexible electrode member 32 may produce better conductivity as it contacts the end of the conduction member 40 perfectly. In addition, by means of the disposition of the inner insulating member 20, it may block the conductivity between the first flexible electrode member 31 and the second flexible electrode member 32.

Figure 4:
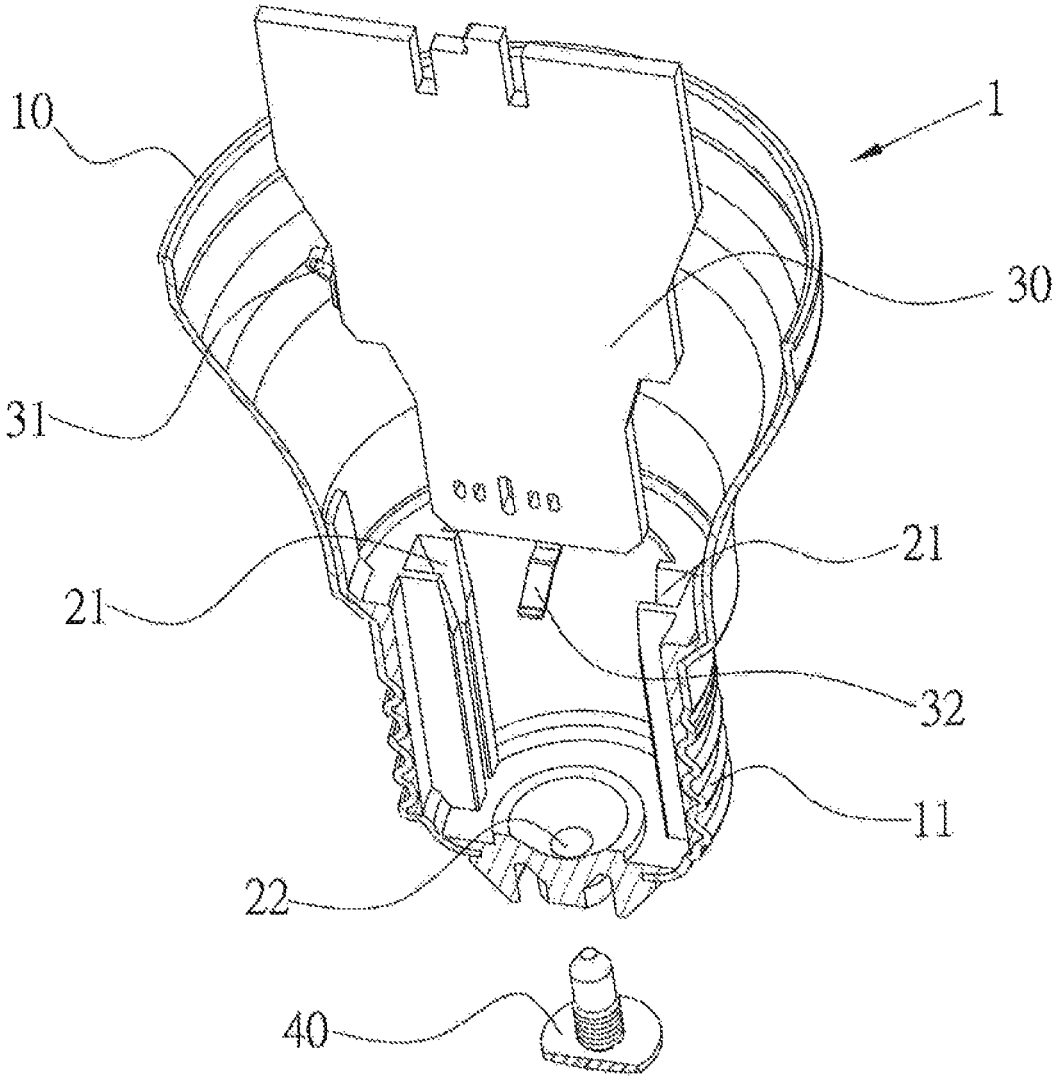
FIG. 4 is a schematic diagram of a substrate of a bulb head structure in accordance with the present invention being disposed in an inner insulating member.

Please refer to FIG. 4. When it comes to the arrangement of the substrate 30 and the conduction member 40, the inner insulating member 20 may have a substrate-receiving part which is disposed at one end of the inner insulating member 20. The substrate-receiving part 21 may be arranged as two grooves which are opposite to each other, and the widths of the grooves correspond to a thickness of the substrate 30, and a distance between bottoms of the two grooves is equal to or slightly smaller than a width of the end of the substrate 30 disposed with the second flexible electrode member 32. That is to say, the substrate 30 and the inner insulating member 20 are assembled to interfere with each other. Hence, when the substrate 30 is assembled, it may merely insert one end of the substrate 30 in the grooves of the substrate-receiving part 21. On the other hand, the inner insulating member 20 may have a conduction member receiving part 22, and the other end of the inner insulating member 20 may be opposite to the substrate-receiving part 21. The conduction member receiving part 22 may be a through hole, and the conduction member 40 may be a cylinder or screw with cap. Hence, the conduction member 40 may be inserted in the conduction member receiving part 22 in an interference manner or may be assembled to the conduction member receiving part 22 by attachment.

When the bulb head structure 1 of the present invention is connected to the lampholder, by using the aforementioned arrangement, it may respectively connect to the positive and negative charges or the negative and positive charges through the lampholder connecting part 11 and the conduction member 40 such that electric power may be obtained and the substrate 30 may thereby enable the LED to emit light. In addition, the conductive connection among each member may be completed instantly after the members are produced, and in the assembling process of the products, wiring and extra operation procedure are unnecessary. It only needs to assemble each member to a combine of the hollow-shaped member 10 and the inner insulating member 20, and as a result, the production efficiency can thereby be increased and is able to be applied to the automated production.

Figure 5:
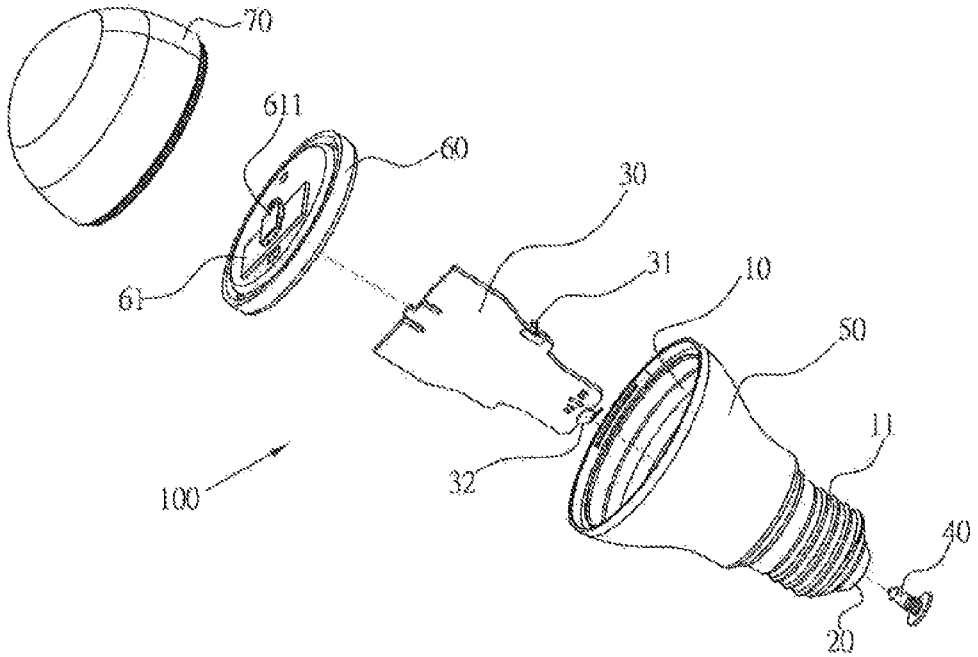
FIG. 5 is an explosion diagram for showing an LED bulb in accordance with the present invention.
Figure 6:
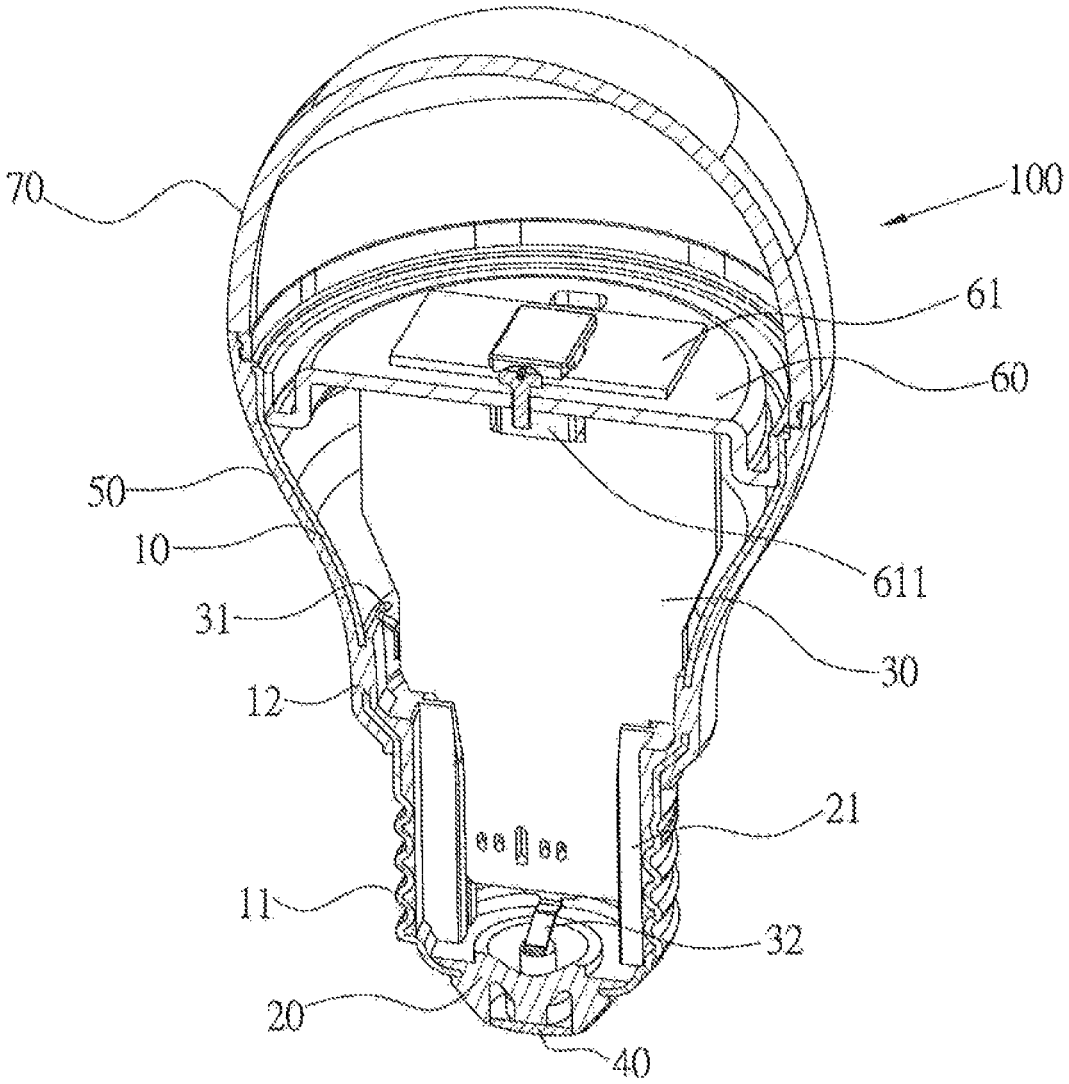
FIG. 6 is a cross-sectional diagram for showing a combined LED bulb in accordance with the present invention.
Figure 7:
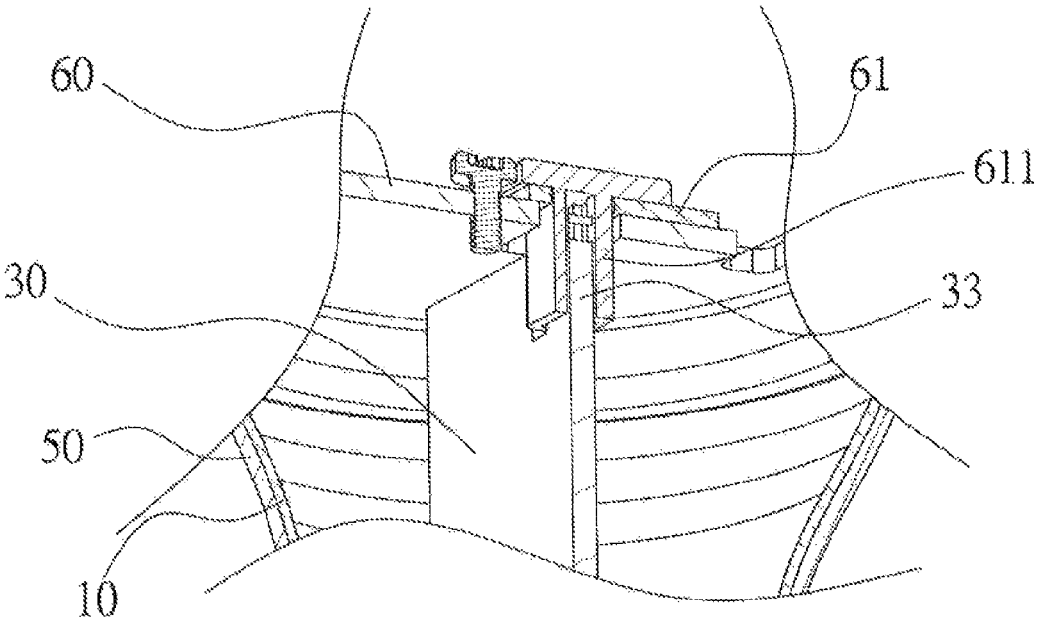
FIG. 7 is a schematic diagram of a substrate of an LED bulb in accordance with the present invention connecting with a light-emitting module.

Please refer to FIG. 5 to FIG. 7 together which are an explosion diagram for showing an LED bulb, a cross-sectional diagram for showing a combined LED bulb and a schematic diagram of a substrate of an LED bulb in accordance with the present invention connecting with a light-emitting module, respectively. In the present embodiment, the arrangements of the members with the same reference numerals are akin to the preceding embodiment, and the unnecessary details are therefore no longer given herein.

As shown in FIG. 5, an LED bulb 100 of the present invention may include the hollow-shaped member 10, the inner insulating member 20, the substrate 30, the conduction member 40, an outer insulating member 50 and a cover member 60. The hollow-shaped member 10, the inner insulating member 20, the substrate 30 and the conduction member 40 are the same as mentioned above, and the outer insulating member 50 may be made of non-conductive materials such as plastic, and may cover outer surface of the hollow-shaped member 10 partially. That is to say, the outer insulating member 50 covers the outer surface of one end of the hollow-shaped member 10 without covering the outer surface of the other end of the hollow-shaped member 10 disposed with the lampholder connecting part 11. It is noteworthy that the inner insulating member 20 and the outer insulating member 50 may be simultaneously formed in inner and outside of the hollow-shaped member 10 through wrapping by injection manufacturing process. In addition, a notch 12 may be disposed on the wall surface of the hollow-shaped member 10 to connect the inner with the outer. Hence, when using wrapping by injection manufacturing process to form the inner insulating member 20 and the outer insulating member 50, it may also use the notch 20 to enable the inner insulating member 20 and the outer insulating member 50 connecting to each other such that the fixity and stability may be thereby promoted when the inner insulating member 20 and the outer insulating member 50 are disposed on the hollow-shaped member 10.

Moreover, the cover member 60 is disposed at the other end of the hollow-shaped member 10. Namely, the cover member 60 covers the opening at the other end of the hollow-shaped member 10. Wherein, the cover member 60 may be directly disposed on the opening at the other end of the hollow-shaped member 10 by an interference method. In addition, the cover member 60 may be disposed with an LED module 61 at the surface of the cover member 60 opposing to the substrate 30, and the LED module 61 may be electrically connected to the substrate 30.

How the LED module 61 electrically connects to the substrate 30 will be explained as follows. Please refer to FIG. 7. The LED module 61 may be disposed with a connecting unit 611 facing substrate 30 to connect to substrate 30. That is to say, the connecting unit 611 is disposed on the surface of the cover member 60 which faces the substrate 30. Here, one end of the substrate 30 corresponding to the connecting unit 611 is disposed with a conductive part 33 at the other end of substrate 30 opposing to the second flexible electrode member 32, and the conductive part 33 may be inserted in the connecting unit 611 such that the substrate 30 and the LED module 61 are thereby electrically connected.

The LED bulb 100 in accordance with the present invention may be easily applied to the automated production by means of the aforementioned structure. The reason lies in that when assembling the LED bulb 100 of the present invention, extra operations such as welding and wiring are unnecessary, and it only needs to assemble each member to the hollow-shaped member 10 one by one.

To be more precise, firstly, one end of the substrate 30 is directly inserted in the substrate-receiving part 21 of the inner insulating member 20, and at the moment, the first flexible electrode member 31 may lean against the inner wall surface of the hollow-shaped member 10 to enable the hollow-shaped member 10 and the substrate 30 being electrically connected. Afterwards, the cover member 60 may be set on the opening at the other end of the hollow-shaped member 10, and meanwhile, the conductive part 33 of the substrate 30 may be inserted in the connecting unit 611 to enable the substrate 30 and the LED module 61 being electrically connected. Next, the conduction member 40 is inserted or attached in the conduction member receiving part 22 of the inner insulating member 22. Finally, a bulb cover 70 is covered to complete the assembly. When the hollow-shaped member 40 is inserted or attached in the conduction member receiving part 22 of the inner insulating member 22, one end of the conduction member 40 may push the second flexible electrode member 32 such that the conduction member 40 and the substrate 30 may thereby be electrically connected.

What has to be addressed is that the aforementioned assembly is one of the applied aspects used to comprehend the spirit of the present invention, and there are the other assembly subsequences can be found. For example, the conduction member 40 may be disposed firstly, and then the substrate 30 and the cover member 60 may be disposed. Hence, it shall not be subject to this restriction.

As mentioned above, when the LED bulb 100 in accordance with the present invention is assembled step by step, each member is therefore electrically connected one by one such that the amount of members and assembly procedure can be simplified greatly. Because the assembly method is very easy, it can be simply applied to the automated production. Consequently, the LED bulb 100 of the present invention is able to effectively save the manufacturing cost of the product.

While the means of specific embodiments in present invention has been described by reference drawings, numerous modifications and variations could be made thereto by those skilled in the art without departing from the scope and spirit of the invention set forth in the claims. The modifications and variations should in a range limited by the specification of the present invention.

What is claimed is:

1. A bulb head structure, comprising:

a hollow cup-shaped member made of a conductive material, and an outer surface of an end of the hollow-shaped member having a lampholder connecting part;

an inner insulating member disposed in the hollow-shaped member and adjacent to the end of the hollow-shaped member;

a substrate disposed in the inner insulating member;

a first flexible electrode member disposed on a surface of the substrate and adjacent to a side wall of the substrate, and the first flexible electrode member being in contact with the hollow-shaped member to establish an electrical connection between the hollow-shaped member and the substrate;

a second flexible electrode member disposed on the surface of the substrate near an end of the substrate and adjacent to the inner insulating member;

a conduction member disposed in the inner insulating member, and the second flexible electrode member being in contact with an end of the conduction member to establish an electrical connection between the conduction member and the substrate; and an outer insulating member which is adjacent to another end of the hollow-shaped member and partially covers an outer surface of the hollow-shaped member, and the outer insulating member and the inner insulating member are disposed on the hollow-shaped member through wrapping by injection manufacturing process.

2. The bulb head structure of claim 1, wherein the inner insulating member is disposed with a substrate-receiving part, and the end of the substrate disposed with the second flexible electrode member is inserted in the substrate-receiving part.

3. The bulb head structure of claim 2, wherein the substrate-receiving part is arranged as two grooves which are opposite to each other, and a distance between bottoms of the two grooves is equal to or slightly smaller than a width of the end of the substrate disposed with the second flexible electrode member.

4. The bulb head structure of claim 2, wherein the inner insulating member has a conduction member receiving part disposed at an enol of the inner insulating member, the end of the inner insulating member is opposite to the substrate-receiving part, and the conduction member is inserted or attached to the conduction member receiving part.

5. The bulb head structure of claim 1, wherein the first flexible electrode member has a first contact part that can be elastically deformed subject to applied force, and the first contact part extends through the side wall of the substrate to contact the hollow-shaped member, a distance between the non-elastically-deformed first contact part and the side wall of the substrate is larger than a distance between the side wall of the substrate and an inner wall surface of the hollow-shaped member.

6. The bulb head structure of claim 1, wherein the second flexible electrode member has a second contact part that can be elastically deformed subject to applied force, and the second contact part extends through the end of the substrate to contact the conduction member, a distance between the non-elastically-deformed second contact part and the end of the substrate is larger than a distance between the end of the substrate and the end of the conduction member.

7. An LED bulb, comprising:

a hollow-shaped member which is a hollow cup-shaped structure made of a conductive material, and an outer surface of an end of the hollow-shaped member having a lampholder connecting part;

an inner insulating member disposed in the hollow-shaped member and adjacent to the end of the hollow-shaped member;

a substrate disposed in the inner insulating member and comprising a first flexible electrode member and a second flexible electrode member, the first flexible electrode member and the second flexible electrode member are disposed on a surface of the substrate, wherein the first electrode flexible is adjacent to a side wall of the substrate to be in contact with the hollow-shaped member so as to establish an electrical connection between the hollow-shaped member and the substrate, and the second flexible electrode member is disposed at an end of the substrate adjacent to the inner insulating member;

a conduction member disposed in the inner insulating member, and the second flexible electrode member being in contact with an end of the conduction member so as to establish an electrical connection between the conduction member and the substrate; and a cover member disposed at another end of the hollow-shaped member, and the cover member disposed with an LED module, the LED module disposed at a surface of the cover member opposing to the substrate, and the LED module electrically connected to the substrate, an outer insulating member adjacent to another end of the hollow-shaped member and partially covering an outer surface of the hollow-shaped member, wherein the outer insulating member and the inner insulating member are disposed on the hollow-shaped member through wrapping by injection manufacturing process.

8. The LED bulb of claim 7, wherein the inner insulating member is disposed with a substrate-receiving part, and the end of the substrate disposed with the second flexible electrode member is inserted in the substrate-receiving part.

9. The LED bulb of claim 8, wherein the substrate-receiving part is arranged as two grooves which are opposite to each other, and a distance between bottoms of the two grooves is equal to or slightly smaller than a width of the end of the substrate disposed with the second flexible electrode member.

10. The LED bulb of claim 8, wherein the inner insulating member has a conduction member receiving part disposed at an end of the inner insulating member, the end of the inner insulating member is opposite to the substrate-receiving part, and the conduction member is inserted or attached to the conduction member receiving part.

11. The LED bulb of claim 7, wherein the first flexible electrode member has a first contact part that can be elastically deformed subject to applied force, and the first contact part extends through the side wall of the substrate to contact the hollow-shaped member, a distance between the non-elastically-deformed first contact part and the side wall of the substrate is larger than a distance between the side wall of the substrate and the inner wall surface of the hollow-shaped member.

12. The LED bulb of claim 7, wherein the second flexible electrode member has a second contact part that can be elastically deformed subject to applied force, and the second contact part extends through the end of the substrate to contact the conduction member, a distance between the non-elastically-deformed second contact part and the end of the substrate is larger than a distance between the end of the substrate and the end of the conduction member.

13. The LED bulb of claim 7, wherein the LED module is disposed with a connecting unit on a surface of the cover member which faces the substrate, another end of the substrate opposite to the end of the substrate having the second flexible electrode member disposed with a conductive part, and the conductive part is inserted in the connecting unit.

* * * * *